US006417818B2

(12) United States Patent
Shipley et al.

(10) Patent No.: US 6,417,818 B2
(45) **Date of Patent: *Jul. 9, 2002**

(54) TENSIONED CORD/TIE-ATTACHMENT OF ANTENNA REFLECTOR TO INFLATABLE RADIAL TRUSS SUPPORT STRUCTURE

(75) Inventors: John Shipley, Sebastian; Bibb Allen, Palm Bay, both of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/827,475

(22) Filed: Apr. 6, 2001

Related U.S. Application Data

(63) Continuation of application No. 09/343,954, filed on Jun. 30, 1999, now Pat. No. 6,219,009, which is a continuation-in-part of application No. 08/885,451, filed on Jun. 30, 1997, now Pat. No. 5,920,294.

(51) Int. Cl.[7] ..... H01Q 15/20
(52) U.S. Cl. ..... 343/915; 343/912
(58) Field of Search ..... 343/915, 912; H01Q 15/20

(56) References Cited

U.S. PATENT DOCUMENTS

| | | | | |
|---|---|---|---|---|
| 2,814,038 A | | 11/1957 | Miller | 343/757 |
| 3,618,111 A | | 11/1971 | Vaughn | 343/840 |
| 4,352,113 A | | 9/1982 | Labruyere | 343/915 |
| 4,364,053 A | | 12/1982 | Hotine | 343/915 |
| 4,482,900 A | | 11/1984 | Bilek et al. | 343/915 |
| 4,578,920 A | | 4/1986 | Bush et al. | 52/645 |
| 4,613,870 A | | 9/1986 | Stonier | 343/915 |
| 4,755,819 A | | 7/1988 | Bernasconi et al. | 343/915 |
| 5,104,211 A | | 4/1992 | Schumacher et al. | 343/915 |
| 5,202,689 A | | 4/1993 | Bussard et al. | 342/10 |
| 5,554,999 A | | 9/1996 | Gupta et al. | 343/909 |
| 5,680,145 A | | 10/1997 | Thomson et al. | 343/915 |
| 5,787,671 A | | 8/1998 | Meguro et al. | 52/653.1 |
| 5,864,324 A | | 1/1999 | Acker et al. | 343/915 |
| 5,920,294 A | * | 7/1999 | Allen | 343/912 |
| 5,990,851 A | | 11/1999 | Henderson et al. | 343/915 |
| 6,219,009 B1 | * | 4/2001 | Shipley et al. | 343/915 |

FOREIGN PATENT DOCUMENTS

| | | | |
|---|---|---|---|
| CH | 685080 A5 | 3/1995 | H01Q/15/16 |
| DE | 291880 A5 | 7/1991 | H01Q/13/02 |
| GB | 758090 | 9/1956 | |
| GB | 838250 | 6/1960 | |
| WO | 1259919 A1 | 3/1987 | |

* cited by examiner

*Primary Examiner*—Hoanganh Le
(74) *Attorney, Agent, or Firm*—Allen, Dyer, Doppelt, Milbrath & Gilchrist, P.A.

(57) ABSTRACT

A collapsible conductive material includes a generally mesh-configured, collapsible surface, that defines the intended reflective geometry of an antenna. A distribution of tensionable cords and ties form radial truss elements with a plurality of inflatable radially extending ribs and posts of a support structure. The antenna is fully deployed once the support structure is inflated to at least a minimum pressure necessary to place the ties and cords in tension so that the reflective surface acquires a prescribed (e.g., parabolic) geometry, which is stably maintained by the radial truss elements.

17 Claims, 2 Drawing Sheets

TENSIONED CORD/TIE-ATTACHMENT OF ANTENNA REFLECTOR TO INFLATABLE RADIAL TRUSS SUPPORT STRUCTURE

CROSS-REFERENCE TO RELATED APPLICATION

This application is a continuation of Ser. No. 09/343,954, filed Jun. 30, 1999, now U.S. Pat No. 6,219,009, which is a continuation-in-part of Ser. No. 08/885,451, filed Jun. 30, 1997, now U.S. Pat. No. 5,920,294, the entire disclosures of which are incorporated herein by reference. U.S. Pat. No. 5,920,294 by B. Allen, is entitled: "Tensioned Cord Attachment of Antenna Reflector to Inflated Support Structure" and is hereinafter referred to as the '294 patent

FIELD OF THE INVENTION

The present invention relates in general to energy directing structures and assemblies, such as antenna reflector architectures, and is particularly directed to a new and improved support configuration for an energy directing surface, such as an RF reflective mesh, having an arrangement of ties and cords that are attached to and placed in tension by an inflated radial, truss-configured support structure, that facilitates compact stowage and stabilized deployment, and is therefore especially suited for spaceborne applications.

BACKGROUND OF THE INVENTION

As described in the above-referenced '294 patent, among the various conventional antenna assemblies that have been proposed for airborne and spaceborne applications are those which employ an inflatable medium, that may be unfurled from its stowed configuration to realize a 'stressed skin' type of reflective surface. In such configurations, non-limiting examples of which are described in U.S. Pat. Nos. 4,364,053 and 4,755,819, the inflatable structure serves as the reflective surface of the antenna; namely, once fully inflated, the material is intended to assume and retain the desired antenna geometry.

Unfortunately, using the inflatable structure per se as the antenna surface creates several problems. First, the accuracy of the geometry of the antenna depends upon how faithfully the shape of the inflatable medium matches the antenna geometry, and also how well the shape of the inflatable medium can be maintained. Should there be (and there can expected to be) a change in the shape of the inflatable membrane, such as due to a change (most notably a decrease) in inflation pressure over time, the corresponding change in the contour of the inflatable structure will necessarily change the intended antenna profile, thereby impairing the energy gathering and focussing properties of the antenna. Although this inflation pressure decrease problem can ostensibly be addressed by the use of an auxiliary supply of inflation gas, it does not circumvent other causes of inflatable membrane distortion, such as, but not limited to, temperature and aging of the material, and particularly the fundamental ability of the inflated membrane to accurately produce the geometry of the antenna reflector.

In accordance with the invention described in the above-referenced '294 patent, this inflation dependency problem is obviated by means of a hybrid antenna architecture, that effectively isolates the geometry of the antenna's reflective surface from the contour of the inflatable support structure, while still using its support functionality to deploy the antenna. For this purpose, rather than make the reflective surface geometry of the antenna depend upon the ability to maintain a prescribed pressure, the inflated membrane is employed simply as a deployable 'tensioning' attachment surface. The inflatable tensioning membrane may support the tensioning tie/cord arrangement and the adjoining antenna surface either interiorly or exteriorly of the inflatable membrane.

FIG. 1 (which, except for the reference numerals corresponds to FIG. 2 of the '294 patent) is a cross-sectional view of an exterior support embodiment of this hybrid antenna architecture. The hybrid structure of FIG. 1 is taken through a plane that contains an axis of rotation AX. A generally parabolic reflective surface 10 of the antenna is made of a lightweight, reflective or electrically conductive material, such as, but not limited to, gold-plated molybdenum wire or woven graphite fiber. This surface is also rotationally symmetric about the axis AX, passing through an antenna feed horn 12.

The reflective surface 10 is attached by a tensioned cord and tie arrangement 20 to the exterior surface 31 of a generally toroidal or hoop-shaped inflatable support structure 30, which is also rotationally symmetric about the axis AX. The inflatable support structure 30 for the tie and cord arrangement 20 is joined to a support base 40 (e.g., a spacecraft) by way of a rigid truss attachment structure 50, that is formed of plurality of relatively stiff stabilizer struts or rods 51, also rotationally symmetric about the axis AX.

The inflatable hoop 30 may comprise an inflatable laminate of multiple layers of sturdy flexible material, such as Mylar. For deployment, the hoop 30 may be inflated through a valve 32, which may be located at or adjacent to its attachment to the truss 50, or the hoop may contain a material that readily sublimes into a pressurizing gas, that fills the interior volume 33 of the hoop 30.

The mesh reflector surface 10 is attached to the inflatable support structure 30 by means of tensionable ties 21 and cords 22 at perimeter attachment points 25, 27, distributed around the exterior surface 31 of the inflated membrane 30. This distribution of ties and cords is rotationally symmetric around the axis AX and is preferably made of a lightweight, thermally stable material, having a low coefficient of thermal expansion, such as woven graphite fiber. The hoop 30 is preferably inflated to a pressure greater than necessary to place the attachment cord and tie arrangement 20 at a minimum tension at which the reflective surface 10 acquires its intended shape.

This hybrid support structure enables the antenna surface to be maintained in a prescribed geometrical shape, that is independent of variations in the inflation pressure and shape of the hoop. Namely, the antenna is deployed and its geometry is fully defined once the inflatable hoop is inflated to at least the extent necessary to place the attachment ties and cords at their prescribed tensions. Preferably, the inflation pressure is above a minimum value that will accommodate pressure variations (drops) that do not allow the hoop to deform to such a degree that would relax or deform the antenna from its intended geometry.

SUMMARY OF THE INVENTION

In accordance with the present invention, the configuration of the inflatable tensioning structure for supporting the tensioning tie/cord arrangement and the adjoining antenna surface exteriorly thereof is that of an inflated arrangement of radially extending ribs and posts, that form radial truss elements with components of the tie/cord arrangement. These ribs and posts are readily collapsible to a compact configuration, to facilitate stowage and deployment, particularly for spaceborne applications. The inflatable rib structure contains a plurality of generally segment-wise curvilinear ribs that extend radially from an antenna boom through which a boresight axis of rotation passes, and to which an antenna feed horn is affixed.

For enhanced stability and rigidity, either or both of the radially extending curvilinear rib segments and the posts may be embedded with or affixed to stiffening elements, such as graphite rods or the like, oriented parallel to the intended directions of deployment. Distal ends of the rib segments and distal and base ends of the posts are connected to a truss-forming arrangement of collapsible cords, and circumferential cord segments. These cords are placed in tension by inflation of the ribs and act to stabilize the intended support geometry of the radial rib structure.

A reflective mesh surface is attached to the distal ends of the radial rib segments by a collapsible arrangement of tensionable ties and a set of radially extending backing cords. The backing cords are connected by tensioning ties to a plurality of attachment points distributed along the radial rib segments. Since the reflective mesh and its attachment ties and cords are collapsible, the entire antenna reflective surface and its associated tensioned attachment structure can be readily furled together with the inflatable radial surface in their non-deployed, stowed state. Each of these respective components of the support structure and the reflective surface readily unfurls into a predetermined geometry, highly stable reflector structure, once the ribs and posts of the radial support structure are fully inflated.

DETAILED DESCRIPTION

Figure 1:
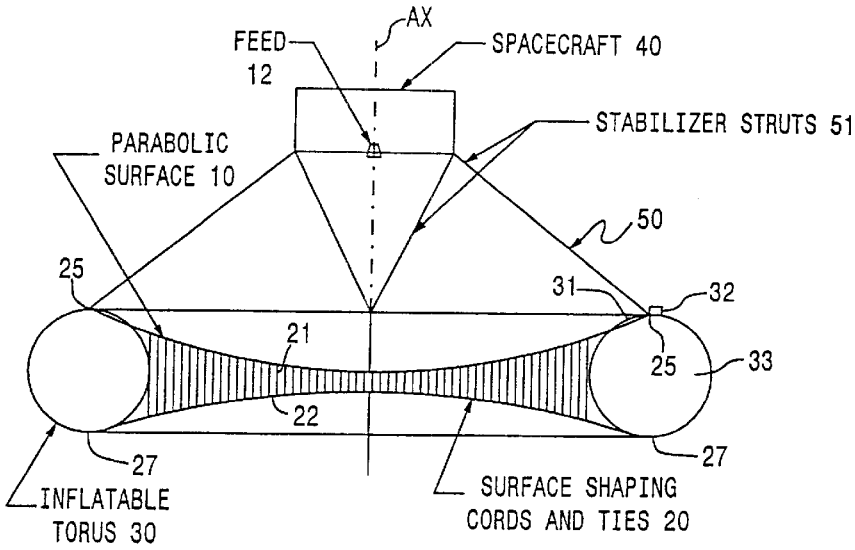
FIG. 1 is a diagrammatic cross-sectional illustration of an architecture of the invention described in the above-referenced '294 patent.
Figure 2:
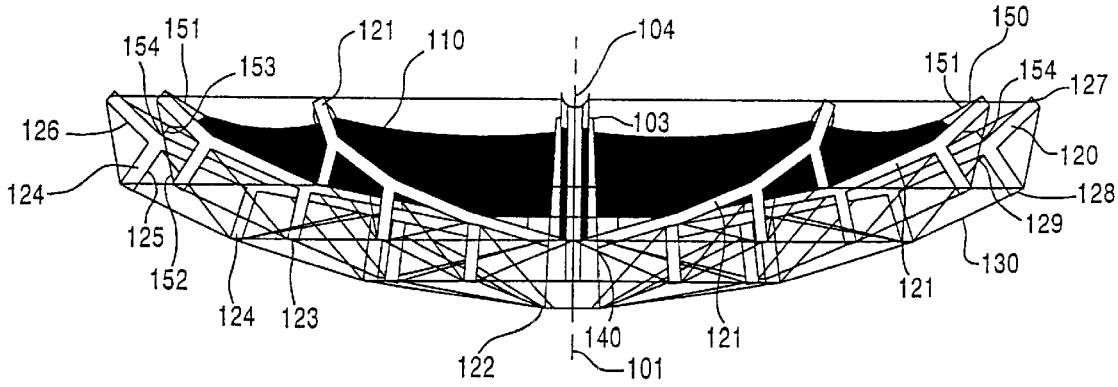
FIG. 2 is a diagrammatic side view of an inflated radial, truss-configured antenna support structure of the present invention.

Attention is now directed to FIG. 2, which is a diagrammatic side view of an inflated radial, truss-configured antenna support structure of the present invention, taken through a plane containing a (boresight) axis of rotation 101. Axis 101 passes though a generally cylindrical boom 103, to which an antenna feed horn 104 is affixed. A collapsible, generally parabolic, energy reflective surface 110 is supported by an associated radially, extending inflatable radial rib structure 120, that is rotationally symmetric about the axis 101.

For purposes of providing a non-limiting illustrative example, the reflective antenna surface 110 may comprise a relatively lightweight mesh, gold-plate molybdenum wire mesh, that readily reflects electromagnetic or solar energy. It may also comprise other materials, such as one that it is highly thermally stable, for example, woven graphite fiber. The strands of the reflective mesh of the reflector surface 110 have a weave tow and pitch that are selected in accordance with the physical parameters of the antenna's intended deployment. It should also be noted that the reflective surface may be used to reflect other forms of energy, such as, but not limited to, acoustic waves.

The inflatable medium of the radially, extending rib structure 120 may comprise a laminate of multiple layers of a sturdy material, that is effectively transparent to energy in the spectrum of interest. For electromagnetic and solar energy applications, a material such as Mylar may be used. Each of the ribs may be configured of a plurality of rib segments 121 that extend radially in a generally segment-wise curvilinear from a base 122 through which axis 101 passes.

Projecting generally orthogonally from a plurality of radially spaced apart locations 123 along each rib segment 121 are respective posts 124. Posts 124 are integrated as part of the radial ribs and are therefore inflated during the inflation of the ribs. This radial rib and post configuration readily allows the rib segments and posts to collapse radially (in an accordion fashion), or they may be folded. When not inflated, the rib structure 120 may be stowed radially around the boom 103.

For enhanced stability and rigidity, the membrane material of either or both of the radially extending curvilinear rib segments 121 and the posts 124 thereof may be embedded with or affixed to lightweight stiffening elements, such as graphite rods or the like, that are oriented parallel to the intended directions of deployment, as shown at 125 and 126. Distal ends 127 of the rib segments 121, and respective distal and base ends 128 and 129 of the posts 124 are connected with a truss-forming arrangement of collapsible cords 130, and circumferential cord segments 132, that are placed in tension by and are operative to stabilize the intended support geometry of the radial rib structure 120 upon its inflation.

Figure 3:
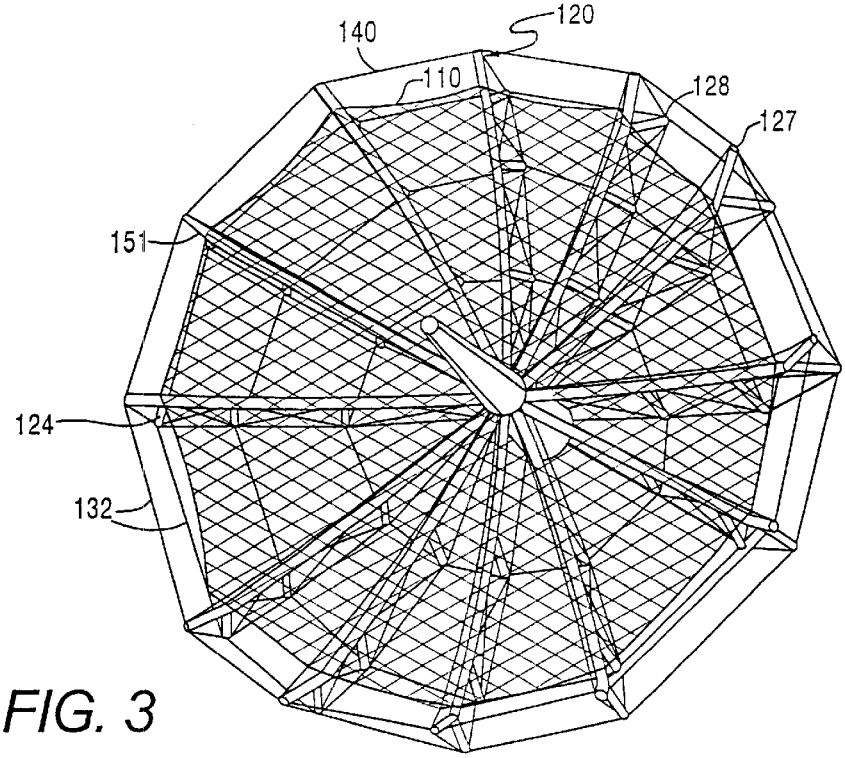
FIG. 3 is a diagrammatic perspective front view of the inflated radial, truss-configured antenna support structure of FIG. 2.
Figure 4:
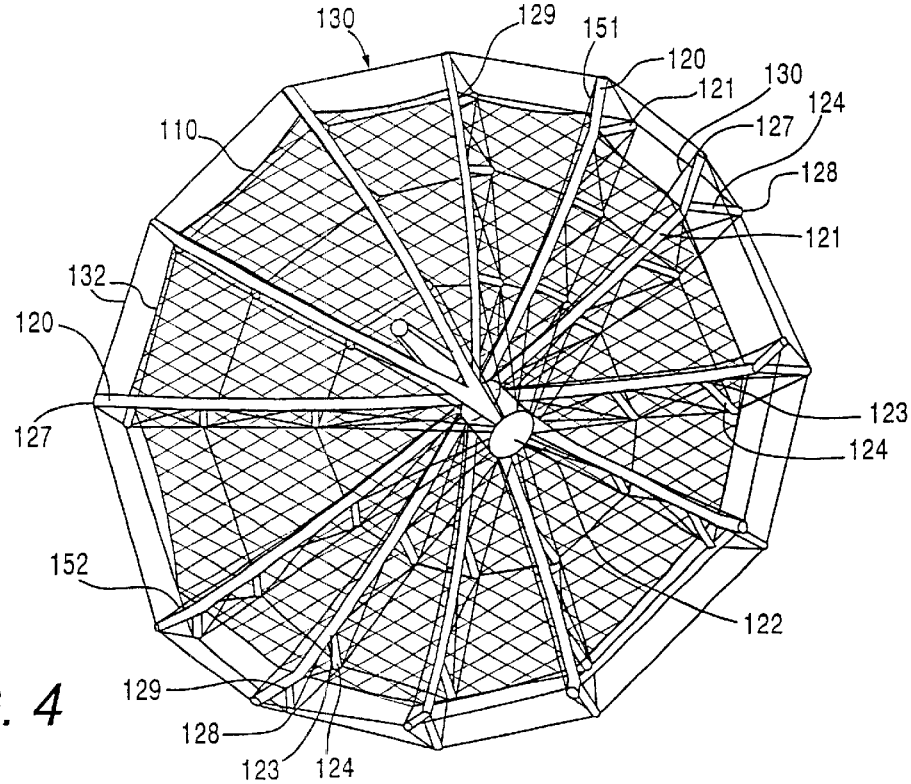
FIG. 4 is a diagrammatic perspective rear view of the inflated radial, truss-configured antenna support structure of FIG. 2.

The rib structure 120 may be inflated by way of an fluid inflation port 140 installed at or in the vicinity of the axis 101. Also, a pressure regulator valve coupled with an auxiliary supply of inflation gas may be coupled to port 140 for maintaining the pressure and thereby the desired 'stiffness' of the inflatable rib structure. Alternatively, the ribs may contain a material (such as mercuric oxide powder, as a non-limiting example) that readily sublimes into a pressurizing gas, filling the interior volume of the truss, thereby causing it to expand from an initially compactly furled or collapsed (stowed) state to the fully deployed state shown in FIGS. 2–4.

Like the inflatable support structures described in the '294 patent, the inflatable radial rib and truss antenna architecture of the present invention effectively isolates the geometry of the reflective surface 110 of the antenna from the contour of the inflatable support structure 120, while still using the support functionality of the inflatable truss to deploy the antenna's reflective surface 110 to its intended (e.g., parabolic) geometry.

For this purpose, the reflective mesh surface 110 is attached to the distal ends 127 of the radial rib segments 121 by a collapsible arrangement 150 of tensionable ties 151, and to a set of radially extending backing cords 152. The backing cords 152 are connected by tensioning ties 153 to a plurality of attachment points 154 distributed along the rib segments 121. Like the other components of the support structure of the invention, these tensionable ties and cords are also preferably made of a lightweight, thermally stable material, such as woven graphite fiber.

With each mesh of the reflective (mesh) structure 110 and its associated attachment ties and cords 150 being collapsible, the entire antenna reflective surface and its associated tensioned attachment structure can be readily furled together with the inflatable radial structure 120 in their non-deployed, stowed state. Each of these respective components of the support structure and the reflective surface readily unfurls into a predetermined geometry, highly stable reflector structure, once the ribs and posts of the radial support structure are fully inflated.

As in the inflatable structure described in the '294 patent, it is preferred that the antenna's radial support structure 120 be inflated to a pressure that is greater than necessary to place the cord and tie arrangement 150 in tension and cause the reflector structure (mesh) 110 to acquire its intended geometry. Such an elevated pressure will not only maintain the support membrane 120 inflated, but will accommodate pressure variations (drops) therein, that do not permit the inflated support membrane to deform to such a degree as to relax the tension in the reflector's attachment ties and cords, so that the reflective surface 110 will retain its intended deployed shape.

As will be appreciated from the foregoing description, the above discussed geometry dependency shortcoming of conventional inflated antenna structures is effectively remedied by the radially configured hybrid antenna architecture of the present invention, which like the inflatable support structure of the '294 patent, essentially isolates the reflective surface of the antenna from the contour of the inflatable support structure, while still using the support functionality of the inflatable truss to deploy the antenna and stably maintain its reflective surface in an intended energy directing geometry.

While we have shown and described an embodiment in accordance with the present invention, it is to be understood that the same is not limited thereto but is susceptible to numerous changes and modifications as are known to a person skilled in the art, and we therefore do not wish to be limited to the details shown and described herein, but intend to cover all such changes and modifications as are obvious to one of ordinary skill in the art.

What is claimed is:

1. An energy directing structure comprising:

an energy directing surface;

an inflatable support structure having collapsible ribs that stow in a compact configuration and inflate to extend radially from an axis of said energy directing surface; and tensionable cords and ties coupled to said energy directing surface and to said inflatable support structure, and forming upon inflation of said collapsible ribs radial truss elements that deploy said energy directing surface in a stable geometric configuration.

2. The energy directing structure according to claim 1, wherein a respective collapsible rib of said inflatable support structure includes inflatable posts projecting from spaced apart locations of said collapsible rib, and wherein said cords and ties are coupled to said inflatable posts.

3. The energy directing structure according to claim 2, wherein said collapsible ribs and inflatable posts of said inflatable support structure are coupled with stiffening elements therefor. pg,15

4. The energy directing structure according to claim 1, wherein each of said collapsible ribs comprises a generally segment-wise curvilinear rib that extends radially away from said axis.

5. The energy directing structure according to claim 1, wherein said inflatable support structure is effectively transparent to said energy.

6. The energy directing structure according to claim 1, wherein said energy directing surface comprises a reflective mesh.

7. An energy directing apparatus comprising:

a collapsible energy directing surface which, when deployed, conforms with a prescribed geometrical shape and is operative to direct energy incident thereon in accordance with said prescribed geometrical shape;

an inflatable support structure having collapsible ribs that stow in a compact configuration and inflate to extend radially from an axis of said energy directing surface; and a distribution of tensionable members, which attach said collapsible energy directing surface to said collapsible ribs of said inflatable support structure, and which are placed in tension when said collapsible ribs of said inflatable support structure are inflated, and form, upon inflation of said collapsible ribs, radial truss elements that deploy said energy directing surface to said prescribed geometrical shape and in a stable geometric configuration.

8. The energy directing apparatus according to claim 7, wherein a respective collapsible rib of said inflatable support structure includes a plurality of inflatable posts projecting from spaced apart locations thereof, and wherein said distribution of tensionable members are connected to said inflatable posts.

9. The energy directing apparatus according to claim 8, said collapsible ribs and inflatable posts are coupled with stiffening elements therefor.

10. The energy directing apparatus according to claim 7, wherein said inflatable support structure contains a plurality of generally segment-wise curvilinear ribs that extend radially away from said axis.

11. The energy directing apparatus according to claim 7, wherein each of said collapsible ribs comprises a generally segment-wise curvilinear rib that extends radially away from said axis.

12. A method of deploying an energy directing surface comprising the steps:

(a) attaching tensionable members to an inflatable support structure having collapsible ribs that stow in a compact configuration and inflate to extend radially from an axis of said energy directing surface; and (b) inflating said inflatable support structure to at least an extent necessary to place said tensionable members in tension, and thereby form, with the collapsible ribs of said inflatable support structure, radial truss elements that deploy said energy directing surface to a prescribed geometrical shape and in a stable geometric configuration.

13. The method according to claim 12, wherein said energy directing surface has a mesh configuration.

14. The method according to claim 12, wherein a respective collapsible rib of said inflatable support structure includes a plurality of inflatable posts projecting from spaced apart locations thereof, and wherein said tensionable members are connected to said inflatable posts.

15. The method according to claim 14, wherein the collapsible ribs and inflatable posts of said inflatable support structure are coupled with stiffening elements thereof.

16. The method according to claim 12, wherein each of said collapsible ribs comprises a curvilinear rib that extends radially away from said axis.

17. The method according to claim 12, wherein said inflatable support structure is effectively transparent to said energy.

* * * * *

UNITED STATES PATENT AND TRADEMARK OFFICE

CERTIFICATE OF CORRECTION

PATENT NO. : 6,417,818 B2
DATED : July 9, 2002
INVENTOR(S) : John Shipley and Bibb Allen It is certified that error appears in the above-identified patent and that said Letters Patent is hereby corrected as shown below:

Column 1,
Line 14, delete " '294 patent" insert -- '294 patent. --

Column 5,
Line 59, delete " therefor. pg,15" insert -- therefor. --

Signed and Sealed this

Nineteenth Day of November, 2002

*Attest:*

*Attesting Officer*

JAMES E. ROGAN
*Director of the United States Patent and Trademark Office*